US005950482A

United States Patent [19]

Nagasawa et al.

[11] Patent Number: 5,950,482

[45] Date of Patent: Sep. 14, 1999

[54] METHOD FOR SHAPING TUBULAR MEMBER

[75] Inventors: Junichi Nagasawa; Makoto Kitamura; Yuichi Kobayashi; Osamu Kato, all of Kanagawa-ken, Japan

[73] Assignee: Tokico, Ltd., Kawasaki, Japan

[21] Appl. No.: 09/038,845

[22] Filed: Mar. 12, 1998

[51] Int. Cl.[6] ..... B21D 9/04; B21D 17/02

[52] U.S. Cl. ..... 72/398; 72/370.04

[58] Field of Search ..... 72/398, 370.01, 72/370.04, 370.21, 370.23, 414

[56] References Cited

U.S. PATENT DOCUMENTS

| | | | |
|---|---|---|---|
| 3,494,170 | 2/1970 | Valleins | 72/398 |
| 4,569,256 | 2/1986 | Pepper | 72/370.04 |
| 5,634,367 | 6/1997 | Yamada | 72/370.01 |

FOREIGN PATENT DOCUMENTS

| | | | |
|---|---|---|---|
| 2683167 | 5/1993 | France | 72/398 |

*Primary Examiner*—Daniel C. Crane

*Attorney, Agent, or Firm*—Wenderoth, Lind & Ponack, L.L.P.

[57] ABSTRACT

A tubular member to be shaped comprises a first portion to be shaped and a second portion other than the first portion. A punch having a projection is inserted into the tubular member and the tubular member is pressed between a die having a recess and an anvil within a range where elastic deformation of the second portion occurs, to thereby form the first portion into an outwardly projecting portion. When the first portion is to be formed into an inwardly projecting portion, a die having a recess is inserted into the tubular member and the tubular member is pressed between a punch having a projection and an anvil within a range where elastic deformation of the second portion occurs, to thereby form the first portion into the inwardly projecting portion.

8 Claims, 5 Drawing Sheets

METHOD FOR SHAPING TUBULAR MEMBER

BACKGROUND OF THE INVENTION

The present invention relates to a method for shaping a tubular member. More particularly, the present invention is concerned with a method for shaping a tubular member, such as a cylinder for a gas spring used in a vehicle, to thereby form an outwardly projecting portion of the tubular member or form an inwardly projecting portion of the tubular member.

Conventionally, in order to form an outwardly projecting portion of a tubular member, a die having a recess is brought into contact with an outer surface of the tubular member, and the tubular member is pressed by a roller from the inside so that the wall of the tubular member is pushed into the recess of the die, to thereby deform the tubular member. In this case, a problem arises, such that when the tubular member is relatively elongated, it is difficult to apply, by the roller, a force sufficiently large for deforming the tubular member.

On the other hand, in order to form an inwardly projecting portion of a tubular member, a die having a recess is brought into contact with an inner surface of the tubular member, and the tubular member is pressed by a punch from the outside so that the wall of the tubular member is pushed into the recess of the die, to thereby deform the tubular member. In this case, in order to remove the die from the tubular member after deformation, it is necessary to use a die comprising a plurality of components, and it is also necessary to use a mechanism for enabling this plurality of components of the die to be successively removed from the tubular member. This leads to a problem, such as an undesirably high operation cost for shaping the tubular member.

BRIEF SUMMARY OF THE INVENTION

It is a primary object of the present invention to provide a method for shaping a tubular member, which is free from the above-mentioned problems accompanying conventional techniques.

In one aspect of the present invention, there is provided a method for shaping a tubular member, the tubular member comprising a first portion to be shaped and a second portion other than the first portion, to thereby form the first portion into an outwardly projecting portion, comprising:

inserting a punch into the tubular member, the punch having a projection conforming to the outwardly projecting portion to be formed from the first portion of the tubular member;

placing the tubular member between a die and an anvil provided at a position opposite the die, the die having a recess which is located at a position corresponding to the projection of the punch; and pressing the tubular member between the die and the anvil within a range where elastic deformation of the second portion of the tubular member occurs, to thereby perform plastic deformation of the first portion of the tubular member between the projection of the punch and the recess of the die.

In another aspect of the present invention, there is provided a method for shaping a tubular member, the tubular member comprising a first portion to be shaped and a second portion other than the first portion, to thereby form the first portion into an inwardly projecting portion, comprising:

inserting a die having a recess into the tubular member;

placing the tubular member between a punch and an anvil provided at a position opposite the punch, the punch having a projection which conforms to the inwardly projecting portion to be formed from the first portion of the tubular member and is located at a position corresponding to the recess of the die; and pressing the tubular member between the punch and the anvil within a range where elastic deformation of the second portion of the tubular member occurs, to thereby perform plastic deformation of the first portion of the tubular member between the projection of the punch and the recess of the die.

DETAILED DESCRIPTION OF THE INVENTION

Figure 1A:
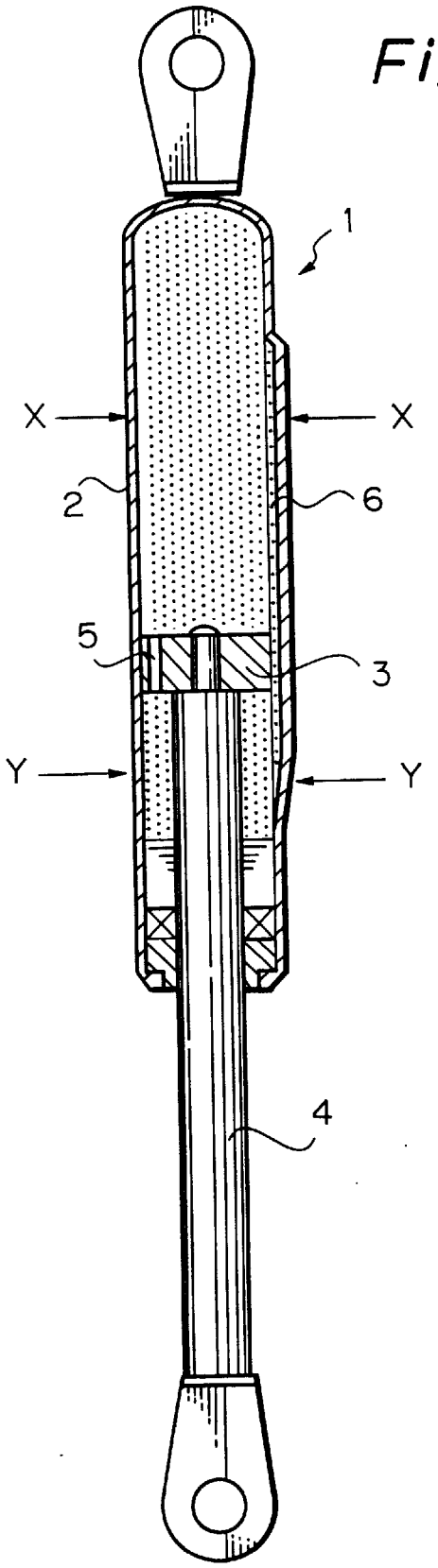
FIG. 1A is an illustration showing a gas spring in which a tubular member shaped according to an embodiment of the present invention is used.
Figure 1B:
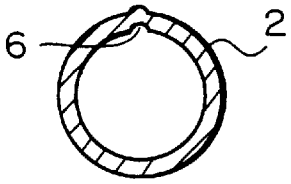
FIG. 1B is a cross-sectional view of the tubular member shown in FIG. 1A, taken along the line X—X .
Figure 1C:
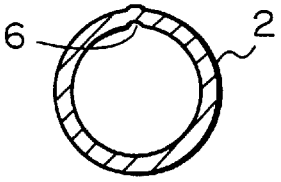
FIG. 1C is a cross-sectional view of the tubular member shown in FIG. 1A, taken along the line Y—Y.
Figure 2:
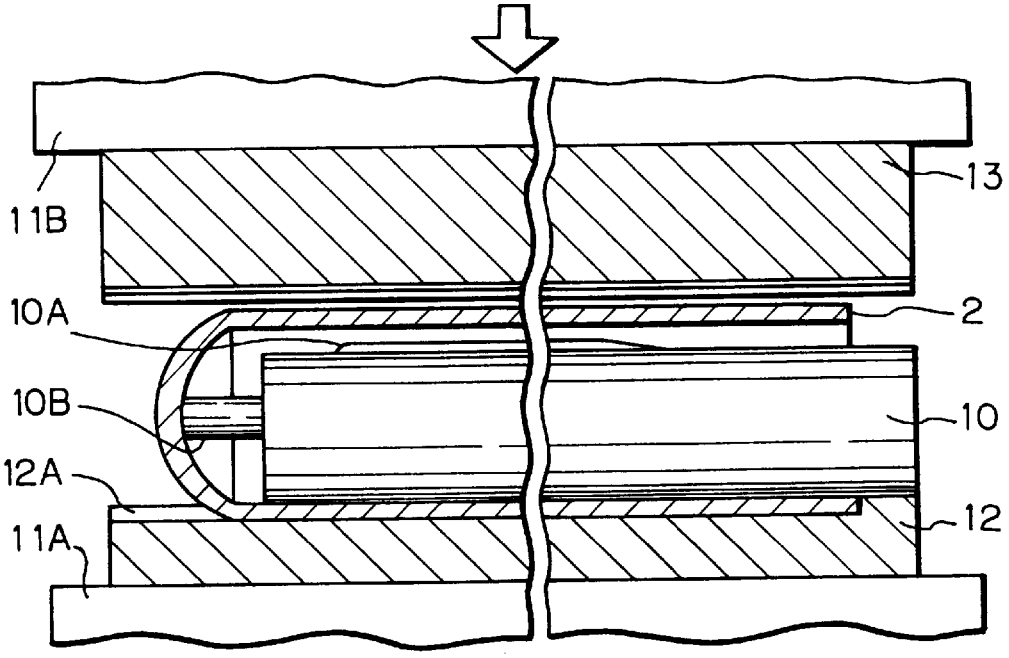
FIG. 2 shows an axial cross-section of the tubular member before shaping, according to the embodiment of the present invention.

As shown in FIG. 1A, a gas spring used in, for example, a rear door of a vehicle comprises a cylinder 2 formed as one piece having one end closed, and a piston rod 4 inserted into the cylinder 2 and having a forward end thereof fixed to a piston 3. A compressed gas and a small amount of hydraulic fluid are sealably contained in the cylinder 2. In this gas spring, generally, a hydraulic fluid passage 5 is formed in the piston 3 to thereby provide a resistance to extension and contraction of the piston rod 4. In a high function gas spring, such as a gas spring 1 in FIG. 1A, an axially extending groove 6 is formed in the cylinder 2. By forming the groove 6 in the cylinder 2, the resistance to extension and contraction of the piston rod 4 is changed, depending on the position of piston rod 4 during extension and compression strokes.

Conventionally, the groove 6 in the cylinder (tubular member) 2 (i.e., an outwardly projecting portion of the cylinder 2) is formed by providing a die having a recess conforming to the groove 6 at a position on an outer circumferential surface of the cylinder 2 on which the groove 6 is to be formed and pressing a roller against an inner circumferential surface of the cylinder 2 in the direction of the recess of the die.

In this conventional technique, when it is intended to form a groove in a cylinder which is thin and has one end closed, disadvantages arise, such that it is difficult to insert a roller into the cylinder. Even when a roller can be inserted into the cylinder, it is difficult to press the roller against the die with a sufficiently large force to deform the cylinder, with the result that a groove cannot be obtained in a desired form.

As a cylinder apparatus having a double cylinder structure, there is a cylinder formed from a tubular member having a recess on an outer surface thereof, that is, a tubular member having an inwardly projecting portion. The inwardly projecting portion of the tubular member is formed by inserting into the tubular member a die comprising a first column-shaped member having a substantially semicircular cross-section, which has a recess conforming to the inwardly projecting portion to be formed, and a second column-shaped member having a semicircular cross-section and pressing a punch against the tubular member from the outside. After forming, the second column-shaped member having a semicircular cross-section is first removed from the tubular member, and the first column-shaped member having a substantially semicircular cross-section is then removed from the tubular member, while avoiding the inwardly projecting portion of the tubular member, which is formed in accordance with the formation of the recess on the outer surface of the tubular member.

That is, in order to form an inwardly projecting portion of the tubular member, from the viewpoint of easy removal of the die from the tubular member after forming, it is necessary to use a die comprising two components and these two components must be successively removed. Therefore, the number of processes necessary for an operation for shaping the tubular member becomes undesirably large.

Hereinbelow, a method for shaping a tubular member according to an embodiment of the present invention is explained, with reference to FIGS. 2 to 5.

Initially, a punch 10 is inserted into the metallic cylinder (tubular member) 2 which is a perform of the cylinder 2 shown in FIG. 1A. The cylinder 2 comprises a first portion 2A to be shaped into the groove 6 and a second portion 2B other than the first portion 2A. The punch 10 is a metallic solid member in the shape of a cylindrical column and has formed on a top thereof a projection 10A conforming to the groove 6 to be formed from the first portion 2A of the cylinder 2. The punch 10 has a small-diameter portion 10B at a forward end thereof for axially positioning the first portion 2A so as to form the groove 6 at a desired position.

Subsequently, the cylinder 2 is placed on an anvil which is in the form of a cradle 12 in this embodiment, which is fixed to a lower holder 11A of a press. An upper surface of the cradle 12 constitutes an axially extending curved surface 12A having a radius of curvature which is slightly larger than that of an outer circumferential surface of the cylinder 2.

Figure 3:
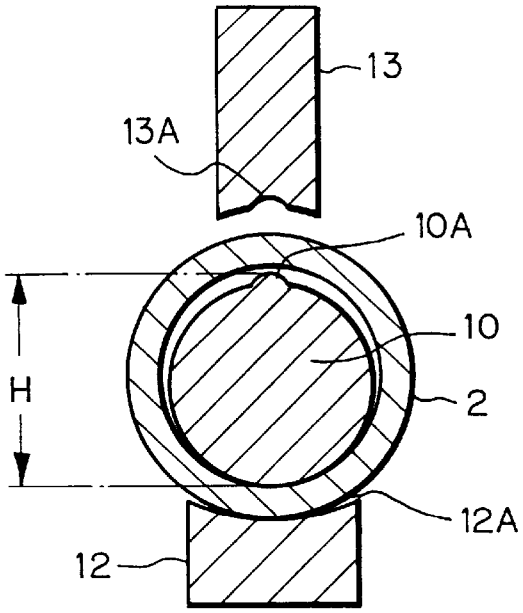
FIG. 3 shows a radial cross-section of the tubular member before shaping, according to the embodiment of the present invention.

A die 13 is fixed to an upper holder 11B of the press. As shown in FIG. 3, a lower surface of the die 13 is provided with a recess 13A conforming to the projection 10A of the punch 10. The die 13 has, on both sides of the recess 13A, a radius of curvature which is slightly larger than that of the outer circumferential surface of the cylinder 2.

Figure 4:
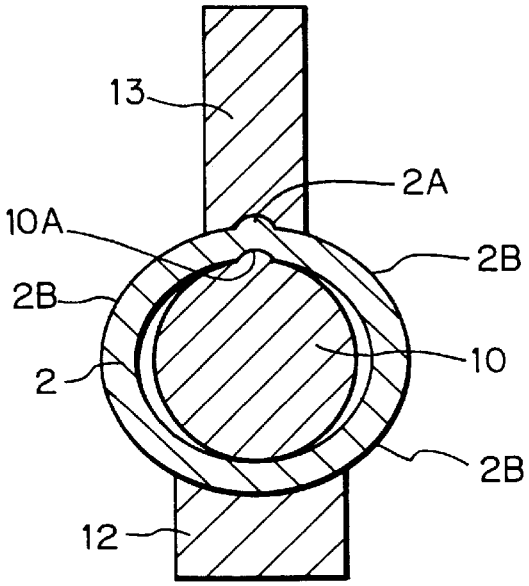
FIG. 4 shows a radial cross-section of the tubular member during shaping, according to the embodiment of the present invention.

When the upper holder 11B of the press is lowered, as shown in FIG. 4, the cylinder 2 undergoes elastic deformation due to a force vertically applied by the die 13 fixed to the upper holder 11B. The first portion (an upper portion of the cylinder 2 in FIG. 4) 2A nipped between the projection 10A of the punch 10 and the recess 13A of the die 13 undergoes plastic deformation, so that the groove 6 is formed.

Figure 5:
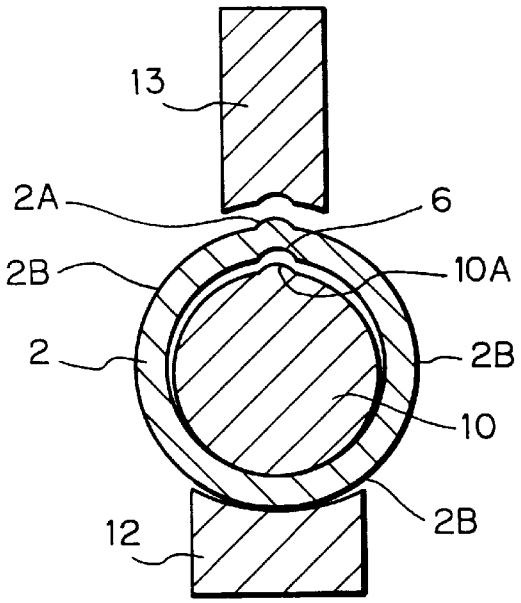
FIG. 5 shows a radial cross-section of the tubular member after shaping, according to the embodiment of the present invention.

Subsequently, as shown in FIG. 5, when the upper holder 11B of the press is lifted, the second portion 2B of the cylinder 2 recovers its original shape having a circular cross-section. Thus, an operation for forming the groove 6 in the cylinder 2 is finished.

Figure 6:
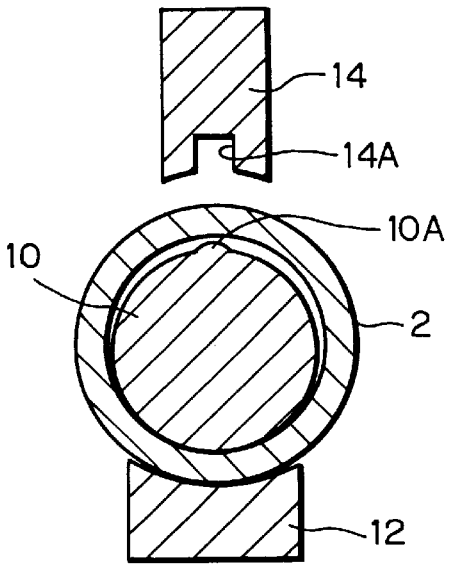
FIG. 6 shows a radial cross-section of a tubular member before shaping, according to another embodiment of the present invention.

In the above-mentioned embodiment, each of the projection 10A of the punch 10 and the recess 13A of the die 13 is shaped so as to substantially conform to the groove 6. However, the shape of the recess 13A is not particularly limited, as long as a groove in the cylinder (an outwardly projecting portion of the cylinder) is obtained in a desired form by nipping the first portion 2A of the cylinder 2 between the projection 10A and the recess 13A. For example, the recess 13A may be a polygonal groove, such as a rectangular groove 14A shown in FIG. 6, which is formed in a die 14 so as to hold the punch 10 at both sides of the projection 10A.

Further, although the groove (outwardly projecting portion) 6 is formed in the cylinder 2 in the gas spring 1 in the above-mentioned embodiment, the present invention is not only applied to formation of an outwardly projecting portion, but also formation of an inwardly projecting portion, as long as these projecting portions are formed by shaping a tubular member.

Figure 7:
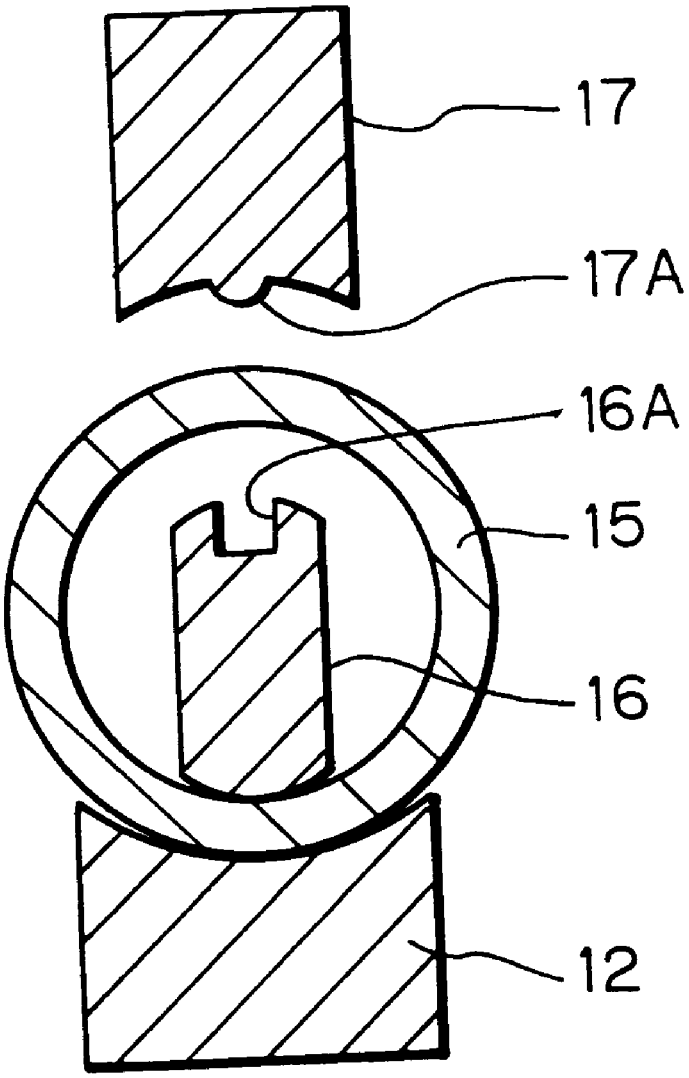
FIG. 7 shows a radial cross-section of a tubular member before shaping, according to a further embodiment of the present invention.

According to another embodiment of the present invention, in order to form an inwardly projecting portion of a tubular member, as shown in FIG. 7, a die 16 having a recess 16A is inserted into a cylinder 15 comprising a first portion to be shaped into the inwardly projecting portion and a second portion other than the first portion and then, the cylinder 15 is pressed between the cradle 12 and a punch 17 having a projection 17A to thereby perform elastic deformation of the cylinder 15.

In this instance, the inwardly projecting portion is formed from the first portion of the cylinder 15 by the projection 17A of the punch 17 and the recess 16A of the die 16.

Subsequently, when the punch 17 is lifted away from the cylinder 15, the second portion of the cylinder 15 recovers its original shape having a circular cross-section, so that the die 16 can be removed from the cylinder 15.

In order to ensure that the die 16 can be removed from the cylinder 15 after forming the inwardly projecting portion, it is necessary to determine the height of the inwardly projecting portion so that the forward end of the inwardly projecting portion does not enter the recess 16A of the die 16 when the second portion of the cylinder 15 recovers its original shape.

In the above-mentioned embodiment in which the outwardly projecting portion of the cylinder is formed, the punch 10 inserted into the cylinder 2 has a substantially circular cross-section. However, in the present invention, the shape of the punch or die inserted into the tubular member is not particularly limited, as long as the punch or die has a height H such that the second portion of the tubular member is capable of recovering its original shape (deformation being an elastic range). For example, the punch or die may have a substantially rectangular cross-section, as in the case of the die 16 shown in FIG. 7.

In the above-mentioned embodiments, an outwardly projecting portion or an inwardly projecting portion is formed at one site in the cylinder. However, in the present invention, for example, the groove 6 may be formed at each of two opposite sites in the cylinder by inserting into the cylinder the punch 10 having the projections 10A on left and right sides thereof, and pressing the cylinder using two dies 13 which are provided at left and right sides of the cylinder. In this case, with respect to the die at the right side of the cylinder, the die at the left side of the cylinder serves as the cradle in the present invention and with respect to the die at the left side of the cylinder, the die at the right side of the cylinder serves as the cradle in the present invention. Further, in the present invention, both an outwardly projecting portion and an inwardly projecting portion may be formed in one cylinder at one time.

In the method of the present invention for shaping a tubular member comprising a first portion to be shaped and a second portion other than the first portion, in which a punch is inserted into the tubular member and the tubular member is pressed between a die and a cradle within a range where elastic deformation of the second portion of the tubular member occurs, the first portion is pressed with a force which is sufficiently large for performing plastic deformation by means of the punch and the die, without using a roller, and the second portion of the tubular member recovers its original shape after the first portion is shaped, so that even when the tubular member has a thin body or a body having one end closed which has been conventionally difficult to shape, an operation for shaping the tubular member into a desired form can be easily conducted by using a punch, die and cradle having simple constructions.

Further, in the method of the present invention for shaping a tubular member comprising a first portion to be shaped and a second portion other than the first portion, in which a die is inserted into the tubular member and the tubular member is pressed between a punch and a cradle within a range where elastic deformation of the second portion of the tubular member occurs, the second portion of the tubular member recovers its original shape after the first portion is shaped into an inwardly projecting portion, thereby enabling the die which has been inserted into the tubular member to be easily removed without interference by the inwardly projecting portion and therefore, an operation for shaping the tubular member into a desired form can be easily conducted by using a punch, die and cradle having simple constructions.

What is claimed is:

1. A method for shaping a tubular member, said tubular member comprising a first portion to be shaped and a second portion other than said first portion, to thereby form said first portion into an outwardly projecting portion, comprising:

inserting a punch into said tubular member, said punch having a projection conforming to said outwardly projecting portion to be formed from said first portion of the tubular member;

placing said tubular member between a die and an anvil provided at a position opposite said die, said die having a recess which is located at a position corresponding to said projection of the punch; and pressing said tubular member between said die and said anvil within a range where only elastic deformation of said second portion of the tubular member occurs, to thereby perform plastic deformation of said first portion of the tubular member between said projection of the punch and said recess of the die so that upon removal of said punch, die and anvil, said second portion recovers from said elastic deformation.

2. A method according to claim 1, wherein said outwardly projecting portion is axially elongated along the tubular member and said tubular member has at least one open end, and said outwardly projecting portion does not reach said at least one open end.

3. A method according to claim 1, wherein said recess of the die has a form conforming to said outwardly projecting portion of the tubular member.

4. A method according to claim 1, wherein said recess of the die has a width substantially equal to a width of said outwardly projecting portion of the tubular member and has a depth larger than a depth corresponding to a height of said outwardly projecting portion of the tubular member.

5. A method for shaping a tubular member, said tubular member comprising a first portion to be shaped and a second portion other than said first portion, to thereby form said first portion into an inwardly projecting portion, comprising:

inserting a die having a recess into said tubular member;

placing said tubular member between a punch and an anvil provided at a position opposite said punch, said punch having a projection which conforms to said inwardly projecting portion to be formed from said first portion of the tubular member and is located at a position corresponding to said recess of the die; and pressing said tubular member between said punch and said anvil within a range where only elastic deformation of said second portion of the tubular member occurs, to thereby perform plastic deformation of said first portion of the tubular member between said projection of the punch and said recess of the die so that upon removal of said punch, die and anvil, said second portion recovers from said elastic deformation.

6. A method according to claim 5, wherein said inwardly projecting portion is axially elongated along the tubular member and said tubular member has at least one open end, and said die is inserted into the tubular member from said at least one open end and said inwardly projecting portion does not reach an end of said tubular member opposite said at least one open end.

7. A method according to claim 5, wherein said recess of the die has a form conforming to said inwardly projecting portion of the tubular member.

8. A method according to claim 5, wherein said recess of the die has a width substantially equal to a width of said inwardly projecting portion of the tubular member and has a depth larger than a depth corresponding to a height of said inwardly projecting portion of the tubular member.

* * * * *

UNITED STATES PATENT AND TRADEMARK OFFICE

CERTIFICATE OF CORRECTION

PATENT NO. : 5,950,482

DATED : September 14, 1999

INVENTOR(S) : Junichi NAGASAWA et al.

It is certified that error appears in the above-indentified patent and that said Letters Patent is hereby corrected as shown below:

On the cover page, insert the missing priority information as follows:

--[30] Foreign Application Priority Data

Mar. 13, 1997 [JP] Japan.....9-079001--

Signed and Sealed this

Twenty-ninth Day of February, 2000

*Attest:*

Q. TODD DICKINSON

*Attesting Officer*

*Commissioner of Patents and Trademarks*